United States Patent [19]

Kuhn

[11] 4,189,934

[45] Feb. 26, 1980

[54] PULLING APPARATUS

[76] Inventor: Charles J. Kuhn, 10520 Plainview Ave., Tujunga, Calif. 91042

[21] Appl. No.: 861,200

[22] Filed: Dec. 16, 1977

[51] Int. Cl.[2] ..... B21D 1/12; B21D 1/14

[52] U.S. Cl. ..... 72/447; 72/705

[58] Field of Search ..... 72/705, 447, 446; 254/74

[56] References Cited

U.S. PATENT DOCUMENTS

| | | | |
|---|---|---|---|
| 3,340,720 | 9/1967 | Chartier | 72/705 X |
| 3,566,666 | 3/1971 | Berendt et al. | 72/705 X |
| 3,566,667 | 3/1971 | Hagerty | 72/705 X |
| 3,589,680 | 6/1971 | Kuhn | 72/705 X |
| 3,612,482 | 10/1971 | Eck | 72/705 X |
| 3,796,084 | 3/1974 | Jarman | 72/705 X |
| 3,817,074 | 6/1974 | Crosthwaite | 72/705 X |
| 3,990,207 | 11/1976 | Eck | 72/705 X |

FOREIGN PATENT DOCUMENTS

| | | | |
|---|---|---|---|
| 463561 | 7/1975 | Australia | 72/705 |
| 50-37143 | of 1975 | Japan | 72/705 |

*Primary Examiner*—Milton S. Mehr
*Assistant Examiner*—D. M. Gurley
*Attorney, Agent, or Firm*—Harness, Dickey & Pierce

[57] ABSTRACT

There is disclosed herein a pulling apparatus comprising a pair of spaced vertical members each of which is supported upon a base member by a pair of depending diverging support members of unequal length which operate to rigidly support the vertical members against the forces exerted thereon during the pulling operation. An additional vertically extending support member also extends from one of the depending support members to further increase the rigidity thereof. The vertical members may each be provided with opposed channels within which a pulley is movably disposed, said pulley being adjustably supported by a chain or the like engaging a load holding assembly provided upon the upper portion of the vertical members.

13 Claims, 9 Drawing Figures

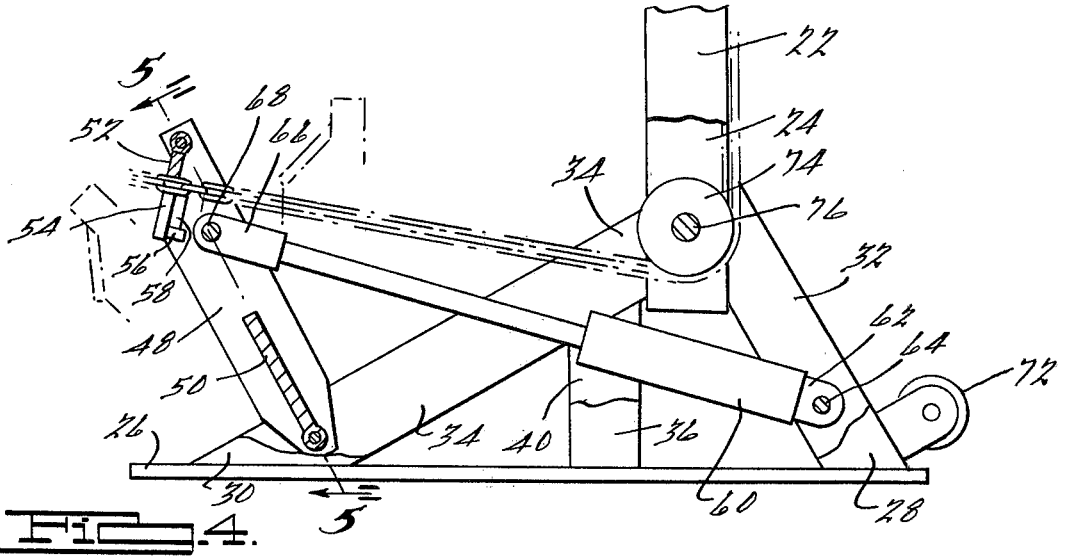
Fig. 4.
Fig. 6.
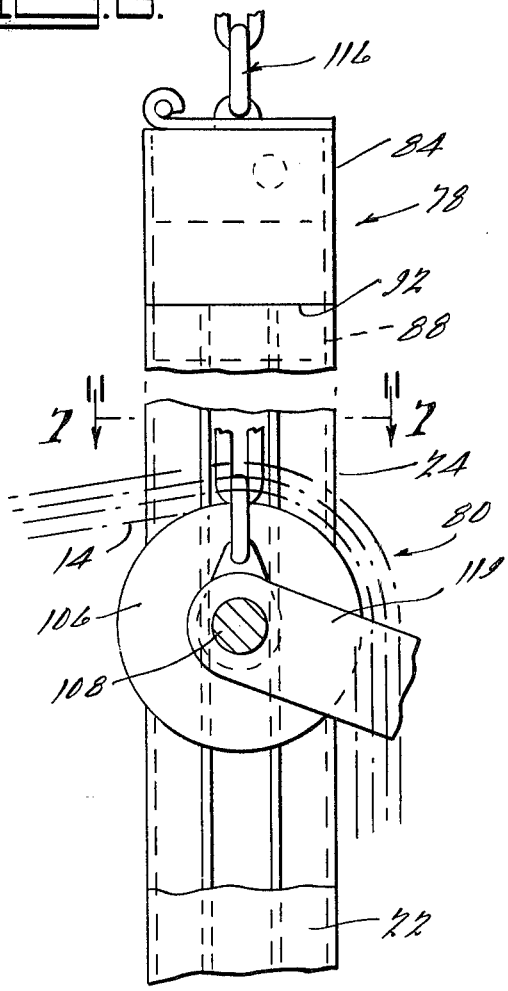
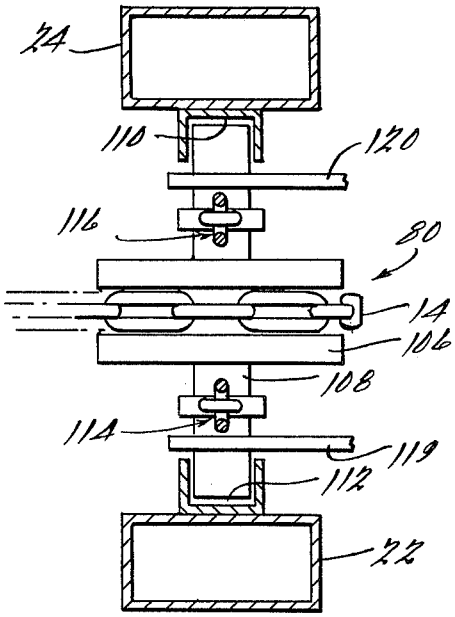
Fig. 7.

PULLING APPARATUS

BACKGROUND AND SUMMARY OF THE INVENTION

The present invention relates generally to pulling apparatus and more specifically to such pulling apparatus as is designed for use in repair of collision damage to motor vehicles such as straightening of frame panels or the like.

Various types of pulling apparatus have long been in use in connection with straightening of motor vehicle frames and other various body components. Generally, such apparatus comprises one or more vertically elongated support members having a plurality of longitudinally spaced holes provided therein. A shaft may be inserted through such holes to variably position guide means such as a pulley through which a chain may be lead and one end thereof attached to an appropriate portion of a motor vehicle. Tensioning means generally in the form of a hydraulically actuated piston is operatively associated with the apparatus and arranged so that the other end of the chain may be connected thereto so as to exert a pulling force upon the motor vehicle. While the plurality of openings afford some degree of height adjustment for the upper pulley, the number or spacing thereof is limited by the necessity for substantial strength in the vertical members without excessively increasing the size thereof and resulting cost and weight. Weight reduction is important in that the pulling apparatus will generally be stored in a remote location thus necessitating it be maneuvered into position for each pulling operation. Further, a particular workpiece may require the apparatus to be repositioned several times to properly effect the repair thereof. Thus, any unnecessary weight will impair the maneuverability thereof.

Typically, the vertical member is supported upon a base by a plurality substantially identical equal length upwardly inclined braces extending therebetween. As each of these braces is substantially identical the size and associated strength thereof is dictated by those carrying the heaviest load. This may result in oversizing the other braces thereby unnecessarily increasing manufacturing costs as well as the weight thereof which may also make maneuvering of the apparatus into position more difficult.

Accordingly, the present invention provides a unique pulling apparatus comprising a pair of vertical members which are each supported in a substantially parallel spaced relationship by a pair of unequal length depending diverging support members arranged so as to distribute the loading thereon in such a manner as to maximize the support thus provided while minimizing the size and weight of such members. The use of minimal size support members without reducing the overall ruggedness and rigidity of the pulling apparatus is important in reducing the cost thereof as well as weight reduction so as to facilitate handling of the apparatus during use. Also, the present invention provides inwardly opening opposed channels on the vertical members within which an upper pulley is movably supported preferably by a pair of chains depending from load holding assembly supported on top of the vertical members. The suspension chains and load holding assembly cooperate with the channels to enable each link of the suspension chains to provide a different working height for the pulley. This feature thus enables greater flexibility in controlling the angle or direction of pulling relative to the workpiece which control is critical to proper, efficient, and effective repair of such motor vehicles or the like.

Additional advantages and features of the present invention will become apparent from the subsequent description and the appended claims taken in conjunction with the accompanying drawings.

BRIEF DESCRIPTION OF THE DRAWINGS

FIG. 4 is a fragmentary view of the lower portion of the pulling apparatus illustrated in FIGS. 1 through 3 having portions thereof broken away;

FIG. 6 is an enlarged fragmentary side elevational view of the upper portion of the pulling apparatus of FIGS. 1 through 3 having portions thereof broken away;

FIG. 7 is a sectional view of a portion of the pulling apparatus of the present invention, the section being taken along line 7—7 of FIG. 6;

DESCRIPTION OF THE PREFERRED EMBODIMENT

Figure 1:
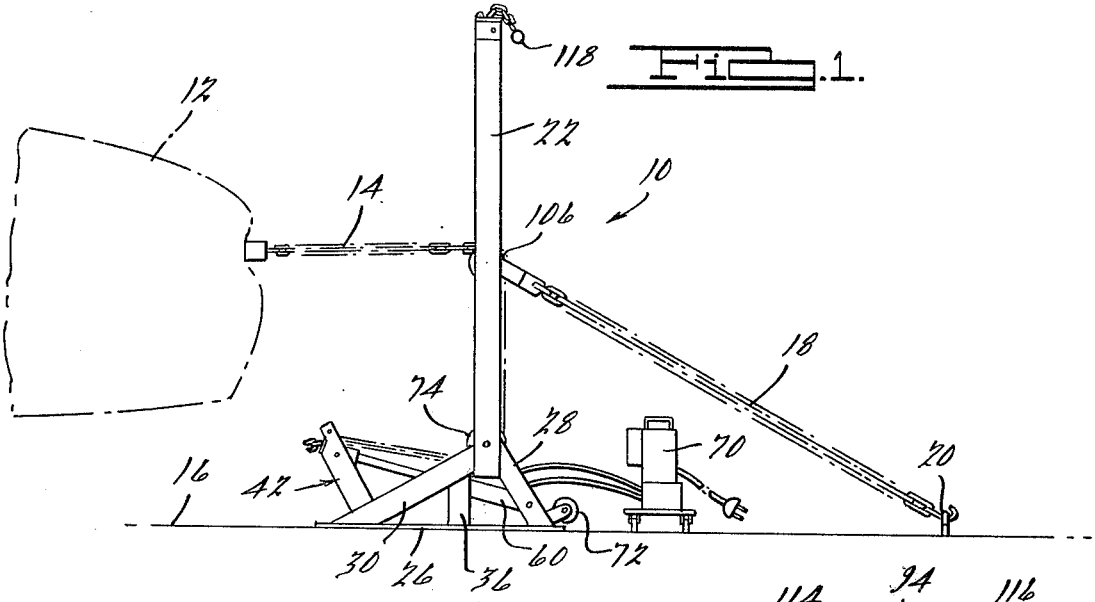
FIG. 1 is a side elevational view of the pulling apparatus in accordance with the present invention shown in operative relationship to a motor vehicle.

Referring now to the drawings and in particular to FIG. 1, there is shown a pulling apparatus 10 in accordance with the present invention illustrated in operative relationship to exert a pulling force upon motor vehicle 12 through flexible connecting member 14 extending therebetween. As shown therein, pulling apparatus 10 is supported upon a generally horizontal surface 16 such as a floor or the like and has anchor means 18 connected to horizontal surface 16 by a suitable anchor bolt 20 or the like which anchor means serves to counteract the pulling force exerted on motor vehicle 12.

Figure 2:
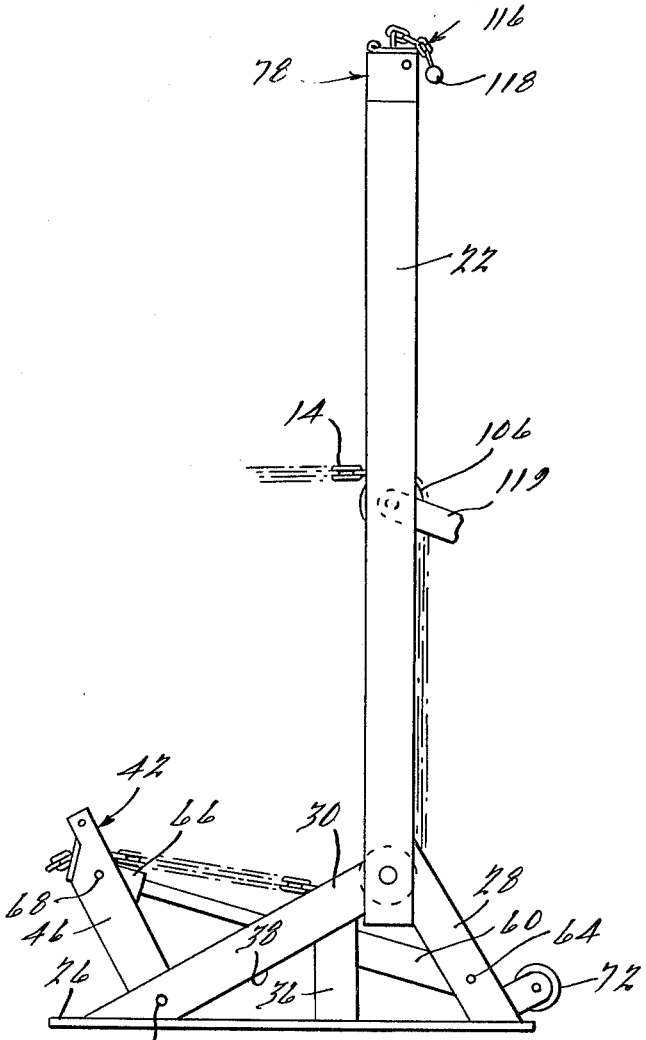
FIG. 2 is an enlarged side elevational view of the pulling apparatus of FIG. 1.
Figure 3:
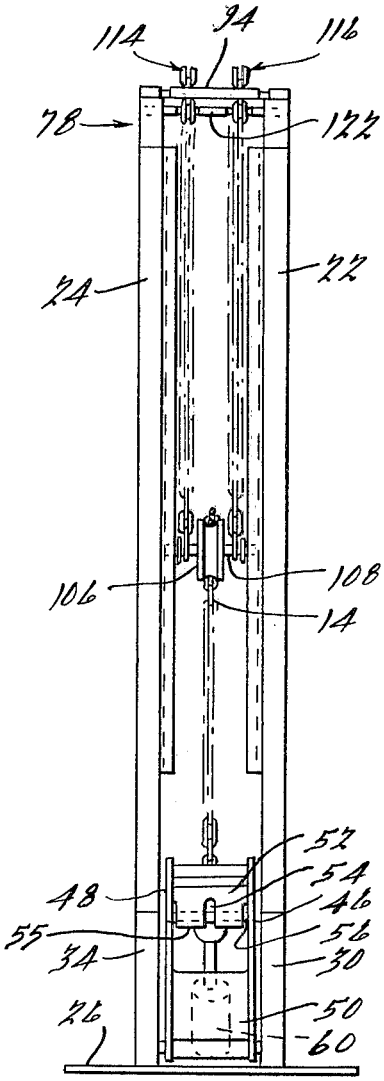
FIG. 3 is an enlarged front elevational view of the pulling apparatus of the present invention.

As best seen with reference to FIGS. 2 and 3, pulling apparatus 10 comprises a pair of spaced substantially parallel vertically extending members 22 and 24 each of which are rigidly supported upon a base member 26 by a pair of depending diverging elongated support members 28, 30, 32, and 34. As shown, vertical members 22 and 24 are hollow and have a generally rectangular cross-section although it should be noted that they may have any other desired cross-sectional shape. An additional generally vertically extending support member 36 is provided having one end fixedly secured to base 26 and another end fixedly secured to the lower surface 38 of support member 30 adjacent its attachment to vertical member 22. Similarly, a second vertically extending support member 40 is positioned in like manner between support member 34 and base 26.

As illustrated, support members 30 and 34 are substantially longer than respective support members 28 and 32 and are arranged with their respective longitudinal axis intersecting at substantially right angles relative to each other. Preferably, support members 30 and 34 will be approximately twice as long as support members 28 and 32 so as to form respective 30–60–90 right triangles. This arrangement, in combination with respective vertical support members 36 and 40, has been found to provide maximum support strength for given size support members thereby affording a relatively light weight and hence easily maneuvered pulling apparatus without sacrificing ruggedness or durability. As shown, longer support members 30 and 34 are positioned on the workpiece side of pulling apparatus 10.

A pivot arm 42 is pivotably secured between support members 30 and 34 adjacent the lower end thereof by means of pin 44 extending therethrough. Pivot arm 42 comprises a pair of spaced planar members 46 and 48 interconnected adjacent the lower end thereof by a longitudinally extending flange portion 50 and having a releaseable connecting means 52 hingedly attached therebetween adjacent the upper end thereof. Preferably, flexible member 14 will be in the form of a chain in which case releaseable connecting means 52 may be in the form of a planar member having an inwardly extending elongated slot 54 centrally disposed along and opening outward along edge 55 thereof. Slot 54 will preferably be of a width slightly greater than the diameter of the rod comprising chain 14, but less than the width of the links so as to engage the next adjacent link thereby preventing chain 14 from sliding therethrough. Stop means 56 are also provided extending between members 46 and 48 so as to limit the pivotal movement of member 52 thus enabling chain 14 to be retained thereby during a pulling operation. Additional lateral stop members 58 may also be provided if desired.

In order to exert a pulling action on chain 14, a hydraulic power cylinder 60 is provided having one end 62 pivotably connected between support members 28 and 32 via pin 64 and another end 66 pivotably connected between planar members 46 and 48 of pivot arm 42 by pin 68 adjacent the upper end thereof. A suitable power source 70 may be connected to power cylinder 60 to control operation thereof.

In order to facilitate manuevering of pulling apparatus 10, suitable wheels 72 are provided on support members 28 and 32 adjacent the lower ends thereof so as to engage surface 16 when pulling apparatus 10 is tilted back thereby enabling it to be rolled into or out of position.

In order to direct the pulling force exerted on flexible member 14, a pulley 74 is rotatably supported upon a shaft 76 extending between vertically extending members 22 and 24 around which flexible member 14 extends. Thus, as is apparent power cylinder 60 is operative to cause pivotal movement of pivot arm 42 thereby exerting a pulling action on flexible member 14 which pulling action is directed upward in a direction substantially parallel to vertical members 22 and 24 by pulley member 74.

A load holding assembly 78 is also provided extending between and supported upon the upper ends of vertical members 22 and 24 which is adapted to adjustably support guide means in the form of a pulley assembly 80 between vertical members 22 and 24.

Figure 8:
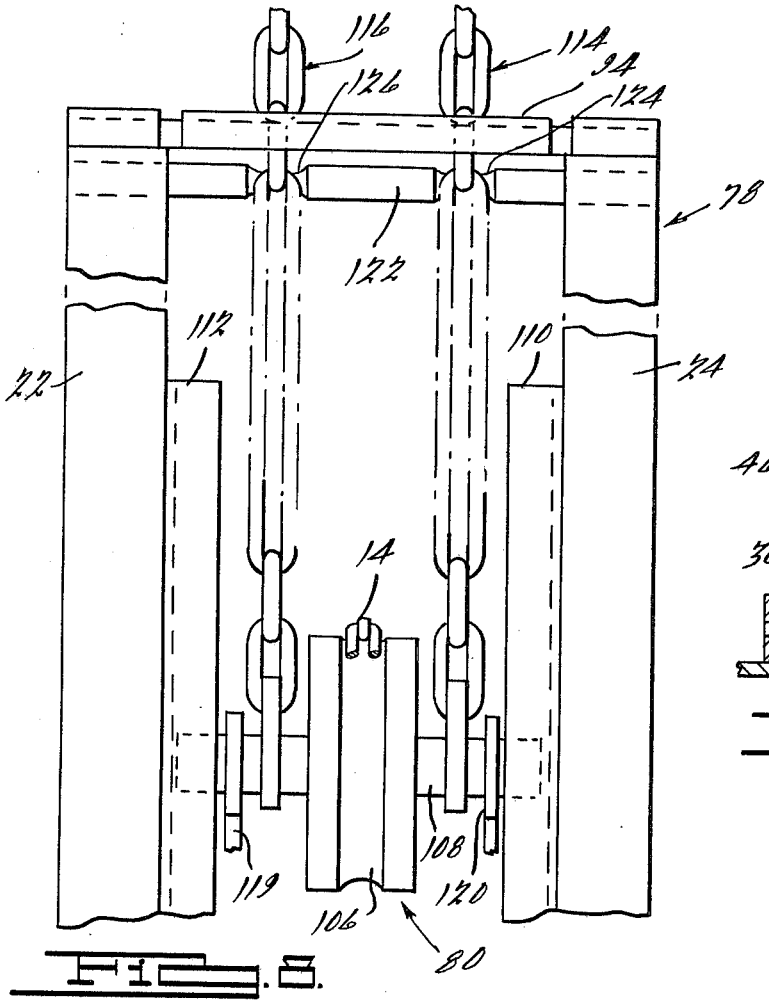
FIG. 8 is an enlarged fragmentary front elevational view of the upper end portion of the pulling apparatus of the present invention.
Figure 5:
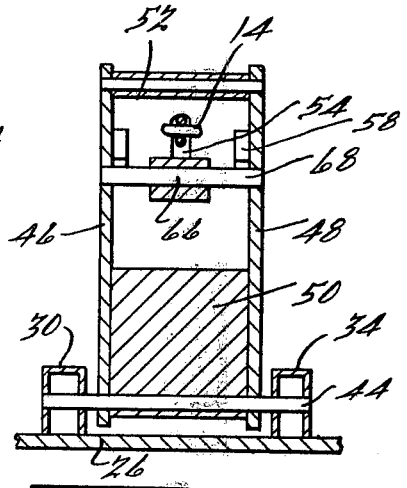
FIG. 5 is a sectional view of the pivot arm of the present invention, the section being taken along line 5—5 of FIG. 4.
Figure 9:
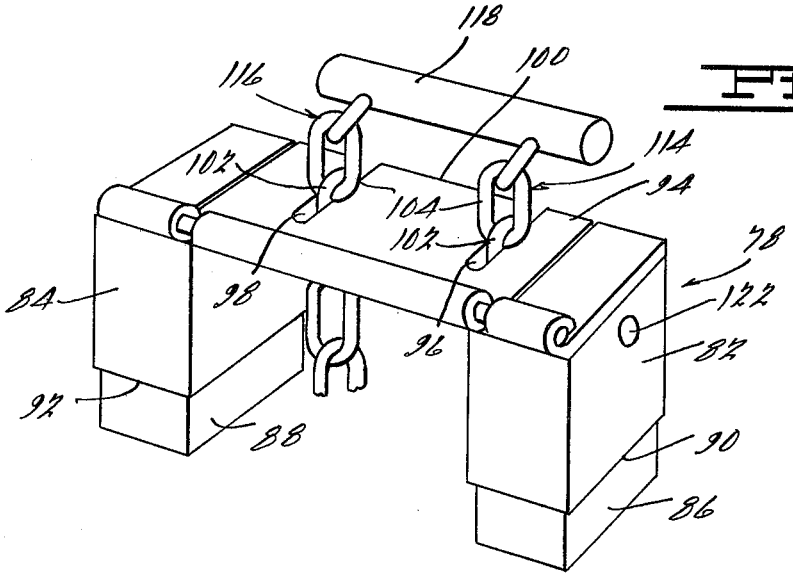
FIG. 9 is a perspective view of the load holding assembly for use in conjunction with the present invention.

As best seen with reference to FIGS. 8 and 9, load holding assembly 78 comprises a pair of spaced generally rectangular shaped slightly elongated members 82 and 84 each of which are provided with a reduced perimeter portion 86 and 88 respectively adjacent their lower ends thereby forming downwardly facing annular shoulders 90 and 92. Preferably, vertical members 22 and 24 will be of hollow rectangular construction and portions 86 and 88 of rectangular members 82 and 84 will be of a size to be received therein thereby enabling load holding assembly 78 to be removably positioned upon vertical extending members 22 and 24.

A planar door member 94 is pivotably secured to the upper ends of and extends between rectangular members 82 and 84 and includes a pair of spaced substantially parallel inwardly extending slots 96 and 98 opening outward along edge 100. Slots 96 and 98 are of a size to accommodate the thickness of chain links 102 but narrow enough to prevent the next adjacent links 104 from passing therethrough.

Pulley assembly 80 is best seen with reference to FIGS. 6 through 8 and comprises a pulley 106 rotatably mounted upon a shaft 108 and adapted to accommodate flexible member 14 used in conjunction with pulling apparatus 10. Shaft 108 is of a length substantially equal to or slightly less than the spacing between vertically extending members 22 and 24 and is adapted to be constrained within inwardly opening longitudinally extending channels 110 and 112 provided on vertically extending members 22 and 24. As is apparent therein, shaft 108 and associated pulley 106 are thereby vertically movable within the guiding channels 110 and 112. In order to support the pulley member at a desired location within vertically extending channels 110 and 112, a pair of chain lengths 114 and 116 are secured to shaft 108 immediately adjacent and on opposite sides of pulley 106. Chain lengths 114 and 116 extend upward in substantially parallel spaced relationship and are connected at their upper ends by means of a handle 118 of a generally cylindrical shape. Anchor means 18 include a pair of spaced members 119 and 120 which are also rotatably secured to shaft 108 so as to enable them to accommodate movement of pulley 106 upward or downward within channel 110 and 112.

In order to set up and operate the present invention, it is first necessary to position pulling apparatus 10 between the vehicle 12 or other workpiece to be operated upon and suitable anchor means provided adjacent thereto. Thereafter flexible member or chain 14 may be connected to the portion to be pulled or straightened. Pulley assembly 80 may then be appropriately adjusted to the desired height which affords an appropriately angle of pull upon the workpiece. This adjustment may be easily accomplished by grasping handle 118 and pulling upwardly thereby causing chains 114 and 116 to raise pulley 106 and shaft 108. Once the desired height is reached, selected links of chains 114 and 116 are inserted in respective slots 96 and 98 of planar door 94 which will then pivot into a closed position supporting pulley 106 at the selected height.

In order to assist in raising pulley 106 and to maintain chains 114 and 116 in proper relationship to door 94, an elongated cylindrical member 122 is provided extending between rectangular members 82 and 84 and has a pair of spaced reduced diameter portions 124 and 126 which act to guide respective chains 114 and 116 during the positioning of pulley 106 and also to maintain the respective chains in proximate relationship to slots 96 and 88 of door 94.

Once pulley 106 has been positioned, chain 14 may be lead therearound and down to and around stationary pulley 74 and to pivot arm 42. Thereafter, it may be pulled taut and an appropriate link thereof inserted in slot 54 thereof.

Anchor means 18 may then be attached to a suitable anchor 20 provided in surface 16 and power means 70 connected to power cylinder 60. Once power cylinder 60 is activated, it will cause pivot arm 42 to rotate toward the workpiece thereby exerting a pulling action on chain 14 and causing the portion of the workpiece to which it is attached to be drawn toward the pulling apparatus. The anchor means will cooperate with chains 114 and 116 to counteract the forces exerted by chain 14.

Thus, the present invention provides an extremely strong rugged pulling apparatus which employs a unique arrangement for supporting the vertical members which arrangement allows lighter weight support members to be utilized without sacrificing ruggedness or durability. Further, as the upper pulley assembly is supported from the top of the vertically extending members there is no need to provide strength reducing openings along the vertical members. This further facilitates fabrication of a lighter weight unit in that smaller vertical members may be employed without reduction in strength. The pulley assembly suspension arrangement also offers the additional advantage of increased positioning flexibility as each link of the support chains represents a new incremental position thereby allowing increased pulling accuracy.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A pulling apparatus comprising:

a base member;

a pair of spaced vertically extending members each of said vertical members including an opposed facing longitudinally extending channel;

a first pair of spaced support members connected between each of said vertical members and said base member;

a second pair of spaced support members connected between each of said vertical members and said base member;

said first pair of support members being substantially longer than said second pair of support members and cooperating therewith to support said vertical members upon said base member;

guide means movably located between said opposed facing channels of said vertical members and movably supported from a load holding assembly supported on the upper ends of said vertical members by at least one chain, said load holding assembly including a load holding door having a slot adapted to receive one link of said chain and to prevent the next adjacent link from passing therethrough, said load holding assembly further including a pair of spaced members adapted to engage respective of said vertical members for supporting said load holding door therebetween and a rotatable cylindrical member extending between said spaced members, said cylindrical member having a reduced diameter portion adapted to receive said chain during movement of said guide means;

pulling means supported on said base member; and flexible connecting means having one end connected to said pulling means and extending through said guide means, another end of said flexible connecting means being adapted to be connected to a workpiece;

said flexible connecting means, said guide means, and said pulling means cooperating to exert a pulling force upon said workpiece and anchor means disposed on the opposite side of said vertically extending members from said workpiece.

2. A pulling apparatus as set forth in claim 1 wherein said first pair of support members is arranged at generally right angles to said second pair of support members and further comprising a third pair of spaced support members extending substantially parallel to said vertical members between said base member and respective of said first pair of support members.

3. A pulling apparatus as set forth in claim 2 wherein said pulling means comprises a pivot arm having one end pivotably secured between said first pair of support members.

4. A pulling apparatus as set forth in claim 3 wherein said pulling means further comprises a hydraulic piston having one end connected between said second pair of support members and another end connected to said pivot arm.

5. A pulling apparatus as set forth in claim 3 wherein said pivot arm further includes connecting means for releaseably engaging said flexible connecting means.

6. A pulling apparatus as set forth in claim 1 further comprising pulley means rotatably connected between said vertical members adjacent the lower end thereof, said pulley engaging a portion of said flexible connecting means intermediate said guide means and said pulling means.

7. A pulling apparatus as set forth in claim 6 wherein said vertical members are hollow and said spaced members of said load holding assembly include portions adapted to be received within said vertical members.

8. A pulling apparatus as set forth in claim 1 wherein said reduced diameter portion is positioned so as to engage said chain and maintain said chain in alignment with said slot in said load holding door.

9. A pulling apparatus as set forth in claim 8 wherein said guide means is supported by a pair of substantially parallel chains each having one end connected thereto and another end connected to handle means extending therebetween, said load holding door having a pair of spaced slots for receiving selective links of said chains.

10. A pulling apparatus comprising:

a base member;

a pair of substantially parallel spaced vertical extending members supported on said base member;

pulling means supported on said base member;

a load holding assembly supported upon the upper end of said vertical members;

vertically movable guide means supported from said load holding assembly;

said vertical members being provided with opposed facing vertical extending channels adapted to receive portions of said guide means so as to guide said vertical movement thereof;

said guide means comprising a pulley rotatably journaled upon a shaft, opposite ends of said shaft being received within said channels, said guide means being vertically supported by a pair of substantially parallel chains each having one end secured to said shaft on opposite sides of said pulley, said load holding assembly including a load holding door having a pair of slots each adapted to receive one link of one of said parallel chains and to prevent the next adjacent link of said one of said parallel chains from passing therethrough, said load holding assembly further including a pair of spaced members adapted to engage respective of said vertical members for supporting said load holding door therebetween and a rotatable cylindrical member extending between said spaced members, said cylindrical member having a pair of reduced diameter portions each adapted to receive one of said parallel chains during movement of said guide means, and flexible connecting means extending from said pulling means through said guide means and having an end adapted to be connected to a workpiece whereby said pulling means may exert a pulling force thereon.

11. A pulling apparatus as set forth in claim 10 wherein said load holding door is pivotably secured between said pair of spaced members and said spaced members are positioned so as to limit downward pivotal movement of said load holding door.

12. A pulling apparatus as set forth in claim 11 wherein said vertical members are hollow and said spaced members of said load holding assembly include portions adapted to be received within an upper end of respective of said vertical members.

13. A pulling apparatus as set forth in claim 10 further comprising anchor means connected to said shaft, said anchor means cooperating with said chains to constrain said shaft during a pulling operation.

* * * * *